United States Patent [19]

Bals et al.

[11] Patent Number: 4,750,093

[45] Date of Patent: Jun. 7, 1988

[54] HEADLIGHT FOR VEHICLES, IN PARTICULAR MOTOR VEHICLES

[75] Inventors: Josef Bals; Horst Flerlage; Diethard Raeder; Dieter Wystrach; Klaus Hegemann, all of Lippstadt, Fed. Rep. of Germany

[73] Assignee: Hella KG Hueck & Co., Lippstadt, Fed. Rep. of Germany

[21] Appl. No.: 50,524

[22] Filed: May 13, 1987

[30] Foreign Application Priority Data

Aug. 7, 1986 [DE] Fed. Rep. of Germany ..... 3626727

[51] Int. Cl.[4] ..... F21M 3/00; F21V 29/00

[52] U.S. Cl. ..... 362/80; 55/385 C; 55/387; 55/385 R; 362/373; 362/294

[58] Field of Search ..... 362/294, 373, 8 D; 55/384, 385 C, 387, 385 R

[56] References Cited

U.S. PATENT DOCUMENTS 2,976,950 3/1961 Smith ..... 55/385 C
4,015,114 3/1977 Paejanen et al. ..... 55/385 R

FOREIGN PATENT DOCUMENTS 2222449 11/1973 Fed. Rep. of Germany ..... 362/373
2346643 3/1975 Fed. Rep. of Germany ..... 362/373

*Primary Examiner*—Albert W. Davis, Jr.
*Attorney, Agent, or Firm*—Max Fogiel

[57] ABSTRACT

The present invention relates to a headlight for vehicles with an interior space enclosed by the reflector and the front cover lens or by the housing and the front cover lens, containing air which is in communication with the atmospheric air surrounding the headlight through the inlet and outlet openings of a duct which is formed by a tube, fabricated from substantially air-impermeable material, projecting from the outside into the interior of the headlight. A reversibly-acting hygroscopic desiccating agent is filled into the duct which provides only a slight resistance to the flow of air into, or out of, the interior of the headlight. The desiccating agent contained in the duct has such an area of contact with the moist air within the headlight that it will absorb enough of the moisture from the air within the headlight, even during the periods of time when the motor vehicle is standing idle, so that condensation of water within the headlight, due to falling temperature, will be avoided. The present invention achieves this object by providing several openings in the walls of the end section of the tube, which projects into the interior of the headlight, to enlarge the contact zone between the desiccating agent and the air within the headlight.

6 Claims, 2 Drawing Sheets

HEADLIGHT FOR VEHICLES, IN PARTICULAR MOTOR VEHICLES

Figure 1:
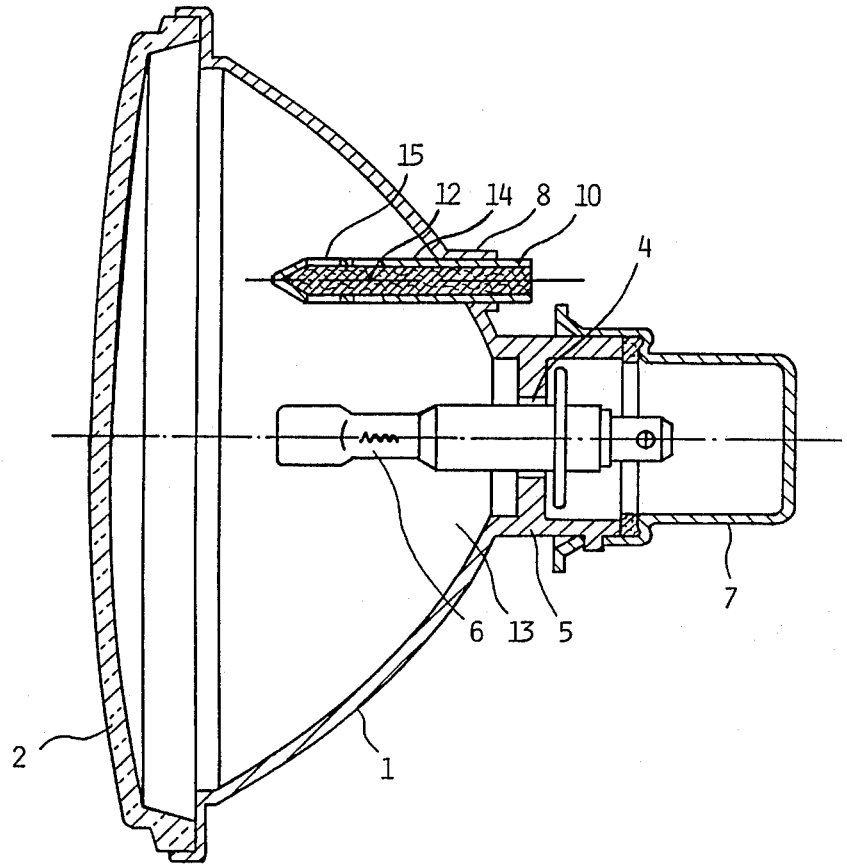

The present invention relates to a headlight for vehicles, in particular motor vehicles, with an interior space enclosed by the reflector and the front cover lens or by the housing and the front cover lens, containing air which is in communication with the atmospheric air surrounding the headlight through the inlet and outlet openings of a duct which is formed by a tube, fabricated from substantially air-impermeable material, projecting from the outside into the interior of the headlight. Reversibly-acting hygroscopic desiccating agent is filled into said duct which provides only a slight resistance to the flow of air into, or out of, the interior of the headlight.

Such a headlight, already known from the German Offenlengungsschrift DE-OS No. 22 22 449, consists essentially of a bowl-shaped reflector, a cover lens in front of the interior of the reflector, an incandescent globe mounted in an opening in the apex of the reflector, and a duct formed from a rod-shaped tube filled with a desiccating agent located in a hot zone above the incandescent globe. The tube is inserted through an opening in the reflector and it provides communication between the air enclosed within the headlight and the environmental air by way of the duct which has an inlet opening and an outlet opening. If there is a difference in air pressure between the interior of the headlight and the surrounding atmosphere, air will flow through the duct in the tube, the jacket of which is impermeable to air in the region between the inlet opening and the outlet opening. The reversibly-acting desiccating agent which is filled into the duct in the rod-shaped tube is able to adsorb moisture at low temperatures and to desorb the adsorbed moisture at higher temperatures.

With such a headlight it is ensured that, during the driving of the vehicle, the interior of the headlight is adequately free from moisture so that water cannot condense on the reflecting surfaces of the reflector bowl or on the cover lens to cause possible damage by corrosion or interfere with the reflection of the light because of water-droplet formation. In this regard the following details are given in support of the invention:

After switching off the incandescent globe of the headlight, the air within the headlight cools and contracts. This causes air to be sucked into the interior of the headlight from the surrounding atmosphere through the duct in the tube which is filled with desiccating agent until pressure equilibrium is established. Any moisture contained in the inflowing air is taken up on the desiccating agent by adsorption. For this reason, moisture cannot gain access to the interior of the headlight.

After the incandescent globe of the headlight is switched on, the temperature of the air within the headlight increases which causes it to expand and flow out through the duct of the tube filled with the desiccating agent. Because of the heating of the desiccating agent the adsorbed moisture is desorbed and entrained in the escaping hot air. This regenerates the desiccating agent. The rod-shaped tube is disposed at a short distance above the incandescent globe so that the desiccating agent will be heated to the highest possible desorption temperature by the switched-on incandescent globe.

Furthermore, when the vehicle is being driven, there is a transitory build up of air pressure due to the frequent passing of other vehicles travelling in the opposite direction or when passing trees and buildings and similar objects. The effect of this is to cause air to flow in through the duct filled with the desiccating agent into the interior of the headlight and the desiccating agent adsorbs any moisture present in the inflowing air, even if the desiccating agent is saturated with moisture before the pressure increase because the water adsorption capacity of the desiccating agent increases directly with the pressure. When the pressure drops again, air flows out through the duct and moisture is desorbed from the desiccating agent because of the decrease in pressure and it is entrained in the out-flowing air. Because of this effect, satisfactory dryness of the air within the headlight is ensured, even if the desiccating agent has not reached saturation point and/or the air surrounding the headlight has a lesser moisture content than the air within the headlight.

During the periods of time when the vehicle is not being driven and which are relatively long in comparison to the actual driving periods, there is an especially great danger that the moisture of the air within the headlight can increase greatly and thus water can condense on the reflection surface of the reflector and on the inside surface of the glass lens. In this regard the following details are given in support of the invention:

With cost-effective mass production methods, it is scarcely possible to manufacture a headlight which is absolutely airtight. Because of unavoidable leakage points in the headlight it is possible for water to enter by capillary action and diffusion of water vapour takes place between the air with a low moisture content present in the interior of the headlight and the surface of the water present in the water-filled capillary spaces which are in communication with the interior of the headlight. It is also possible for moisture to gain access to the interior of the headlight by permeation through the walls of a reflector fabricated from a synthetic plastics material.

Temperature differences between day and night, and variable energy radiation, because of solar radiation and its interruption by passing clouds, and so forth, can often bring about sufficient activation of the desiccating agent and an adequate flow of air for pressure equilibration through the duct filled with desiccating agent. However, the activation of the desiccating agent and the flow of air, in the case of a vehicle which has been standing idle for long periods of time, may be too slight to ensure adequate dryness of the air within the headlight.

Especially in the phases during which the air pressure within the headlight and in the environment are the same, that is to say, when there is no flow of air through the duct, the danger arises that the moisture content of the air within the headlight will increase so sharply that water will be able to condense within the headlight when there is a drop in temperature. Undoubtedly, the desiccating agent in the vicinity of the opening in the duct into the interior of the headlight can adsorb moisture from the air but, none the less, the amount of water adsorbed can only be very slight because the area of the contact zone between the desiccating agent and the air within the headlight is very small and the saturation point of the desiccating agent in this restricted contact zone is rapidly reached.

The object of the present invention is the further development of a motor vehicle headlight of the type initially described, so that the advantages already described may be fully exploited and the desiccating agent contained in the duct will have such an area of contact with the moist air within the headlight so that it will adsorb enough of the moisture from the air within the headlight, even during the periods of time when the motor vehicle is standing idle, so that condensation of water within the headlight, due to falling temperature, will be avoided.

The present invention achieves this object by making provision for several openings in the walls of the end section of the tube, which projects into the interior of the headlight, to enlarge the contact zone between the desiccating agent and the air within the headlight. The moisture which is adsorbed from the air in this contact zone by the desiccating agent is desorbed and is entrained in the heated air which flows out through the duct to the outside of the headlight.

It is an added advantage if the openings in the wall of the free end of the tube are configured as elongated slots which run lengthwise in at least the same direction as the longitudinal axis of the rod-shaped tube. This type of perforated tube may be fabricated as a separate integral unit. The openings in the wall of the free end of the tube may also be in the form of a sieve.

It is an additional advantage if the tube is open at its free end within the interior of the headlight. With such an arrangement, the greater part of the air flows through this opening at the free end of the tube which, because of its greater cross-sectional area, offers less resistance to the air flow than do the smaller elongated openings in the wall of the tube. For this reason, when the air is flowing to the outside from the interior of the headlight, the adsorbed moisture is almost completely desorbed from the desiccating agent and is entrained in the out-flowing air.

It is likewise an advantage when the ratio between the sum of the areas of the elongated openings in the free end of the tube and the cross-sectional area of the free bore of the rube is at least 2:1. This arrangement ensures the optimal functioning of the tube filled with desiccating material.

Furthermore, it is also an advantage if the rod-shaped tube is fabricated by injection moulding or by pressure diecasting and the rod-shaped tube is provided with a base free from openings on the end section, which has the openings, to serve as a gate during the manufacture of the tube. The method of manufacture is very simple and cost-effective.

Figure 2:
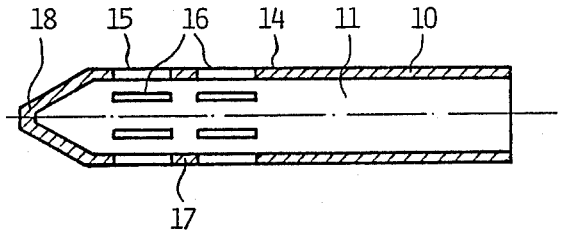
Figure 3:
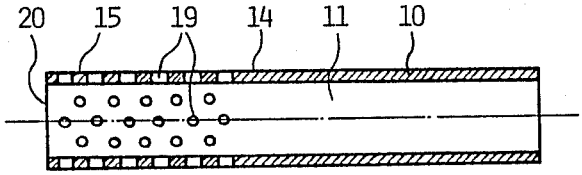

The invention is illustrated in the drawings in which:

FIG. 1 is a vertical section through the centre of a reflector within which a rod-shaped tube filled with desiccating agent is located above the incandescent globe, FIG. 2 is a form of embodiment of the rod-shaped tube as a separate component and FIG. 3 is another form of embodiment of the rod-shaped tube.

The headlight illustrated in FIG. 1 has an interior space 13 defined by a reflector 1, and the cover lens 2. There is an opening 4 in the apex of the reflector which is surrounded by a neck-shaped extension 5 on the rear surface of the reflector. An incandescent globe 6 is inserted from the rear into the reflector 1 through the opening 4. A cover cap 7 is placed on over the neck-shaped extension 5.

The duct 11 formed by the rod-shaped tube 10 is filled with reversibly-acting hygroscopic desiccating agent 12 which consists, for example, of small particles such as granules or chips, or the like. The air in the interior 13 of the headlight is in communication with the environmental air surrounding the headlight by way of the duct 11. The duct 11 filled with the desiccating agent 12 displays a smaller resistance to the flow of air than any other leakage points of the headlight structure. The portion 14 of the rod-shaped tube 10 which projects into the interior 13 of the headlight possesses several openings in its end region 15.

FIG. 2 is a representation of an example of embodiment of the rod-shaped tube 10 as a separate component without the filling of desiccating agent. The openings in the wall of the end region 15 of the tube 10 are in the form of elongated slots 16. The elongated slots 16 run lengthwise in a direction parallel to the longitudinal axis of the rod-shaped tube 10. For reasons of stability and rigidity, the elongated slots are interrupted at intervals by bridges 17 formed by the wall of the tube 10. The free end of the tube has a base portion 18 which does not have any openings in it. This serves as a gate in the manufacture of tube 10 by the diecasting process. Another example of embodiment of the rod-shaped tube 10 is illustrated in FIG. 3. There is a plurality of small openings 19 in the free end 15 of the tube 10 which projects into the interior 13 of the headlight. The free end 20 of the tube 10 in the interior of the headlight has a large opening which is equal in area to the cross-sectional area of the bore of the duct 11.

The claims defining the invention are as follows:

1. A headlight for a motor vehicle, comprising: a housing and a cover lens enclosing an interior space of said headlight; a tube member having a duct with inlet and outlet openings; air in said interior space communicating with atmospheric air surrounding the headlight through said inlet and outlet openings; said tube member being comprised of air-impermeable material and projecting from outside of said headlight into said interior space; a reversibly-acting hygroscopic desiccating agent in said duct and providing substantially less resistance to flow of air into and out of said interior space than any other leakage points in the headlight; said tube having a wall at an end section of said tube with a plurality of openings through said wall, said end section projecting into said interior space; said openings increasing contact surface between said desiccating agent and air within said headlight, so that water within said interior space is removed both when the vehicle is moving and when the vehicle is stationary.

2. A headlight as defined in claim 1, wherein said tube has a longitudinal axis, said openings in said wall of said end section comprising substantially elongated slots running lengthwise in substantially the same direction as said longitudinal axis.

3. A headlight as defined in claim 1, wherein said end section of said tube has a sieve-shaped configuration.

4. A headlight as defined in claim 1, wherein said tube has a free end open to said interior space.

5. A headlight as defined in claim 2, wherein the ratio of the areas of said elongated openings in said end section of said tube to the cross-sectional area of said duct is at least 2:1.

6. A headlight as defined in claim 1, wherein said tube has a base portion at the end of said section having said openings, said base portion being free from openings and comprising a gate when fabricating said tube member by injection molding or by pressure diecasting.

* * * * *